United States Patent [19]

Baba et al.

[11] 4,348,566

[45] Sep. 7, 1982

[54] RHODIUM ELECTRICAL CONTACT OF A SWITCH PARTICULARLY A REED SWITCH

[75] Inventors: Masanori Baba, Suzaka; Toshito Hara, Sagamihara, both of Japan

[73] Assignee: Fujitsu Limited, Kawasaki, Japan

[21] Appl. No.: 135,180

[22] Filed: Mar. 28, 1980

[30] Foreign Application Priority Data

Mar. 29, 1979 [JP] Japan ..... 54/36275

[51] Int. Cl.[3] ..... H01H 33/66

[52] U.S. Cl. ..... 200/144 B; 200/262; 200/263; 200/265; 75/172 G; 75/173 R; 335/151; 335/196

[58] Field of Search ..... 75/172 G, 173; 200/144 B, 262, 265, 263; 335/151, 196

[56] References Cited

U.S. PATENT DOCUMENTS 2,241,262 5/1941 Keitel ..... 200/144 B

*Primary Examiner*—Robert S. Macon

*Attorney, Agent, or Firm*—Staas & Halsey

[57] ABSTRACT

In a rhodium electrical contact of a switch, particularly a reed switch, from 0.1 to 10 atomic % of Ag is included in the electrical contact. The electrical contact of the invention has a long life under a various loading conditions from a non-working condition, where an electric current is neither conducted nor broken by the switch, to a working condition, where erosion of the electrical contact is caused by short arcs between members of the electrical contact.

19 Claims, 20 Drawing Figures

| REGION | CAUSE OF EROSION | ANODE | CATHODE |
|---|---|---|---|
| A | ARC | CRATER | PIP |
| S | SHORT ARC | PIP | CRATER |
| B | BRIDGE | PIP | CRATER |
| M | MECHANICAL EROSION | — | — |

Rh
N
O
C
Cl
S
Bi
Rh
dN/dE
ENERGY OF ELECTRONS (eV)

( x 1000 )

( x 10000 )

(x 1000)

(x 10000)

RHODIUM ELECTRICAL CONTACT OF A SWITCH PARTICULARLY A REED SWITCH

The present invention relates to an improvement of a rhodium electrical contact and, more particularly, to a rhodium electrical contact used in a reed switch.

A material for electrical contacts is required to have the following properties, generally speaking. The electric resistance is low, the melting point and boiling point are high, the vapor pressure of the material at the operational temperature of the switch is low, the resistance against a corrosive gas is good and the hardness is sufficiently high to provide the material with a wear resistance.

The reed switch mentioned above generally has the following structure. A pair of reed pieces consisting of a magnetic material is enclosed or sealed in a sealing ampoule, such as a glass tube, and the reed pieces are positioned in the sealing ampoule in such a manner that a front end of one of the reed pieces is spaced from and overlaps the front end of the other reed piece. The sealing ampoule contains an inert gas or reducing gas. An energizing coil is arranged around the sealing ampoule, or a permanent magnet is movably arranged at the outside of the ampoule.

The switching function of the reed switch is realized by the following a method. A magnetic field is applied to the interior of the sealing ampoule by conducting an energizing current across the energizing coil or displacing the permanent magnet to the proximity of the sealing ampoule. As a result of the application of the magnetic field, a magnetic attracting force is generated between the front ends of the pair of reed pieces defining a space therebetween. The reed pieces are, therefore, attracted to each other and the front ends, which form the contact part of the reed switch, are closed or made. When the energizing coil is deenergized or the permanent magnet is moved away from the sealing ampoule, the magnetic field disappears in the sealing ampoule, with the result that the reed pieces having a resilient property are deflected or released to the stationary position due to the resilient force of the reed pieces. The reed switch is, therefore, opened or broken.

In the reed switch using a relatively soft gold silver and an alloy of gold and silver as a contact material, the reed pieces are in contact with each other over a relatively large surface area of the contact material layer, and the contact material is liable to quickly erode. When the erosion extends to the underlying body of the contact material body, the underlying body is partly exposed and the reed pieces cannot be separated due to adhesion between the exposed underlying body and the contact material layer, which is hereinafter referred to as breaking inferiority.

A material used as a contact material should have the properties mentioned above and, in addition, should have such a property that the contact resistance between the contact members is low. A stable contact between the contact members can be ensured for a long time by such low contact resistance.

Rhodium is more expensive than gold, but has a good corrosion resistance, a higher hardness than gold and provides the contact part of reed pieces with a low contact resistance. The use of rhodium as the electrical contact material of a reed switch is described in "Miniature Semi-hard Magnetic Dry-reed Switch", reported by Takeo Kitazawa, Toshiro Oguma and Toshito Hara, in the proceedings of the 19th Annual National Relay Conference, Apr. 27 and 28, 1971.

The operating conditions of reed switches will first be explained and, then, the characteristics of the rhodium electrical contact for reed switches will be explained.

The operating conditions of the reed switches and other sealing switches are as follows.

A. Low Level Condition

Making and breaking of the switches are conducted under a low load, for example, lower than several tens of millivolts (mV) and several milliampere (mA).

B. Non-working Condition

An electric current is neither conducted through nor broken by the switches.

C. Working Condition

An electric current is conducted through and broken by the switches. An electric discharge phenomenon accompanies the making and breaking operations of the switches. In this electric discharge the following two kinds of electric discharge are generated depending upon the loading condition of the switches. An arc discharge is generated when the load is resistance but not inductance, and a glow or arc discharge is generated when the load is resistance and capacitance.

In FIG. 1 electric current and voltage, as well as the main cause of erosion of a rhodium electrical contact of a reed switch are illustrated. The load of the reed switch is a resistance. Referring to the region A of FIG. 1, the arc discharge phenomenon of the working condition mentioned in item C, above, is generated. On the positively charged reed piece or anode of the reed pieces, the surface of the rhodium contact material layer becomes convex, and convexes referred to as craters are formed on this surface. On the other hand, concave shapes referred to as pips are formed on the surface of the rhodium contact material layer on the cathode of the reed pieces.

In the region S of FIG. 1, the arc discharge phenomenon of the working condition mentioned in item C, above, is also generated, but the arc is short. The rhodium contact material layers are eroded due to the formation of pips and craters on the anode and cathode of the reed pieces, respectively. In the region B of FIG. 1, the contact part of the reed switch is heated due to a Joule heat and the rhodium on the higher temperature reed piece is captured by the rhodium layer on the lower temperature reed piece. Therefore, bridges are formed between the reed pieces and the rhodium layers of reed pieces are thus eroded.

The region M of FIG. 1 corresponds to the non working condition and the low level condition mentioned above. In the region M, the reed pieces made of a magnetic material elongate or shrink due to the magnetostriction of the magnetic material, when the reed pieces are made due to the magnetic field applied from an energizing coil and the like. The rhodium contact material layers are, therefore, forced to frictionally displace relative to each other and are mechanically eroded.

A disadvantage of the rhodium electrical contact of the reed switches is that the rhodium contact material layers are liable to erode in the region M mentioned above. As a result of such erosion, the underlying body of the rhodium contact material layer, usually a gold plating layer, is partly exposed at the eroded parts of the rhodium contact material layer. Such erosion is hereinafter referred to as abnormal erosion. The generating rate of the abnormal erosion is, for example, 30% of the reed switches when the making and breaking operation is repeated 300,000 times. As a result of the abnormal erosion, breaking inferiority occurs or the releasing time, namely the time required for breaking an OFF normal electrical contact, becomes longer than the designed value. The breaking inferiority and the occurrence of a longer releasing time than the designed value are hereinafter collectively referred to as OFF inferiority. The OFF inferiority is caused by the fact that gold, which is liable to adhere or stick to the rhodium is exposed at the contact part, or by the fact that the rhodium contact material layers are firmly engaged with each other due to the pips and craters on these layers. Such engagement is referred to as locking. In the production of the reed switches, all reed switches are subjected to inspection of switching. When OFF inferiority occurs, the yield of producing the reed switches becomes low.

It is known from German Auslegeschrift 25 41 925 that the electrical contact-material layer of a reed switch is produced by, firstly, depositing on the reed pieces a lower tin layer and an upper rhodium layer, and secondly, heating these layers to the diffusion temperature of tin and rhodium. The rhodium-tin contact of this German Auslegeschrift advantageously prevents the formation of bridges in the region B of FIG. 1, because the contact part of the rhodium-tin contact is made even and flat due to the melting of tin. However, the rhodium-tin contact is extremely eroded in the regions S, and that is the disadvantage of the rhodium-tin contact.

It is object of the present invention to improve the known rhodium electrical contact, thereby providing a novel electrical contact used particularly for reed switches, said contact ensuring a long life of switches used under broad ranges of voltage and current, and under various loading conditions.

Desirably, the above mentioned current and voltage ranges are the S, B and M ranges of FIG. 1, and the life is at least ten million making-and breaking-operations at a voltage of 48 V and a cable load used in telephone exchanges, and at least one million making-and breaking-operations at a voltage of 50 V, a 100 mA and a resistance load.

In accordance with the object of the present invention, there is provided a rhodium electrical contact of a switch, namely an electrical contact consisting essentially of rhodium, characterized in that the electrical contact contains from 0.1 to 10 atomic % by weight of silver (Ag).

The advantage offered by the present invention are mainly longer life of the electrical contacts as compared with that of the conventional rhodium condition under every loading condition corresponding to the regions S, B and M of FIG. 1. In addition, the electrical contact according to the present invention has an advantageously low resistivity of, for example, 4.7$\mu\Omega$. cm, a high hardness of, for example, Hv 1000, and a high resistance against corrosive gases. These properties are as excellent as in the electrical contact comprising rhodium but not silver.

The present invention is hereinafter explained with reference to FIGS. 2 through 20, wherein.

Figure 4:
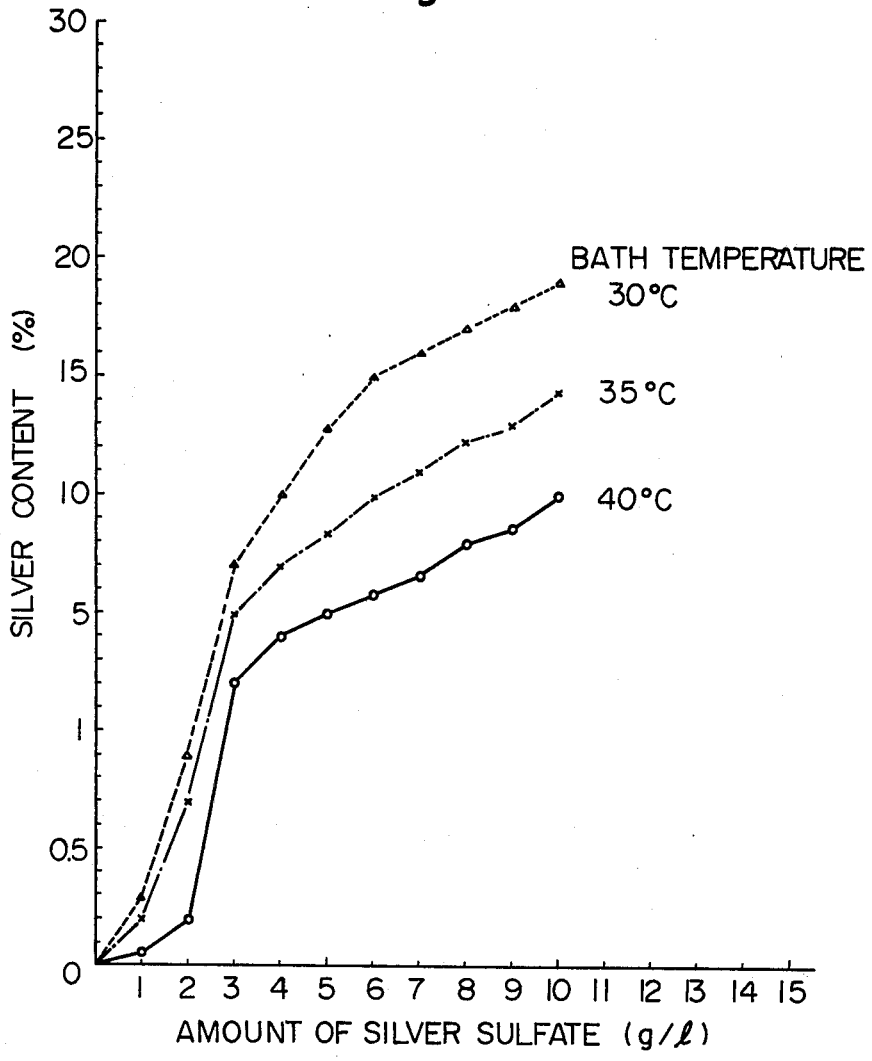
Figure 5:
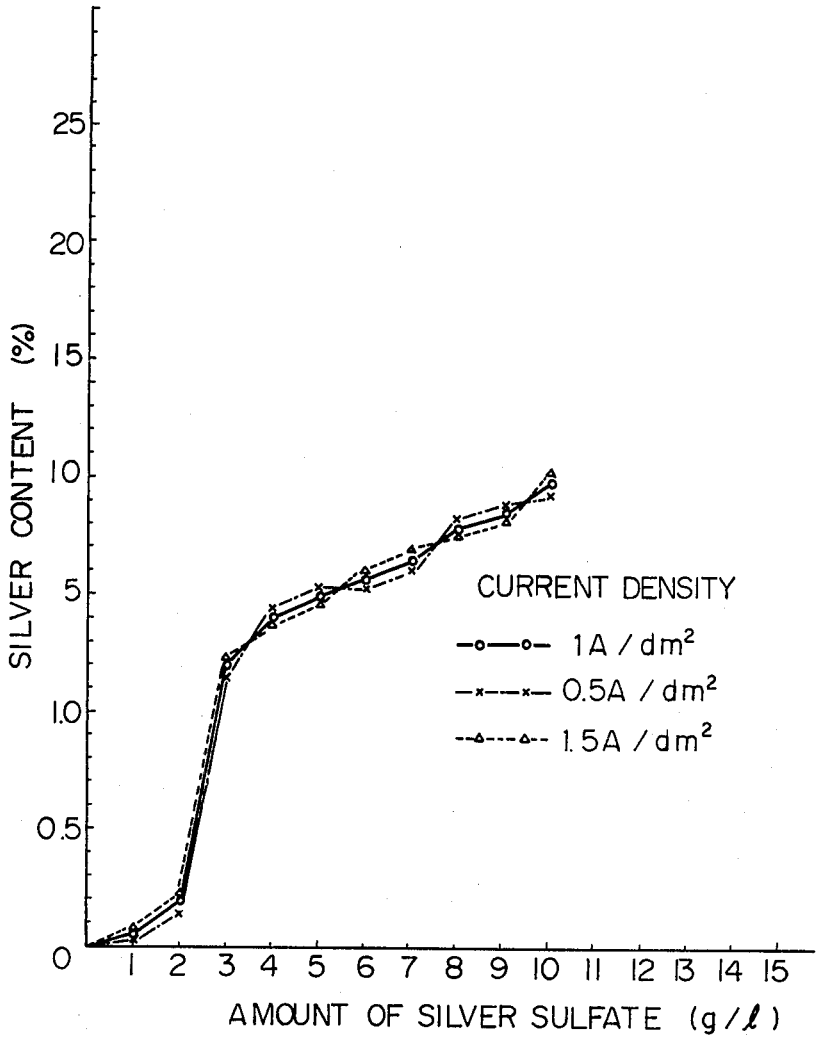
Figure 6:
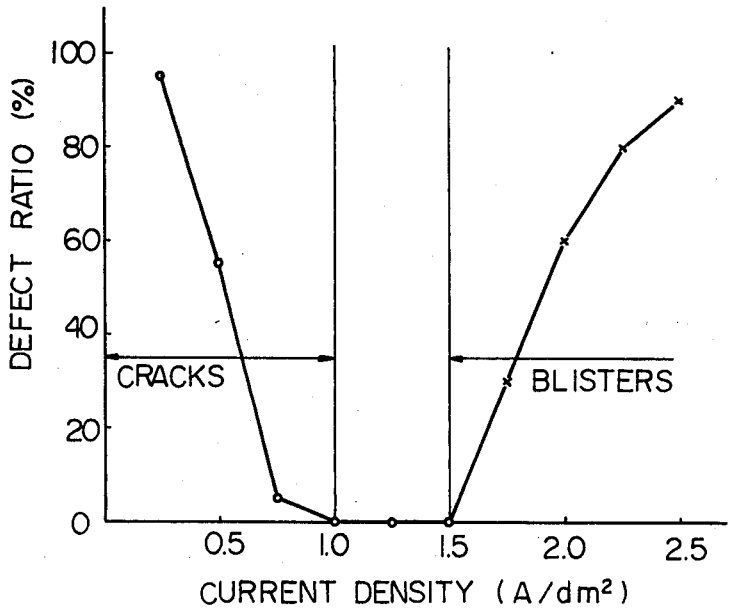
Figure 7:
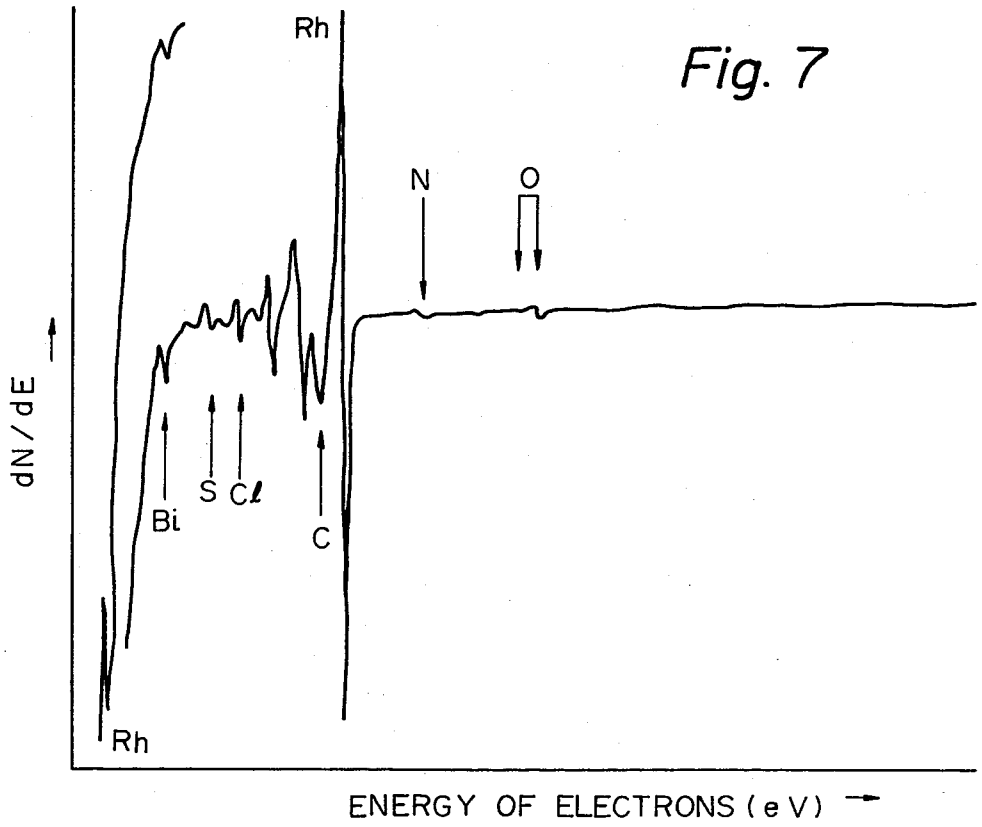
Figure 8:
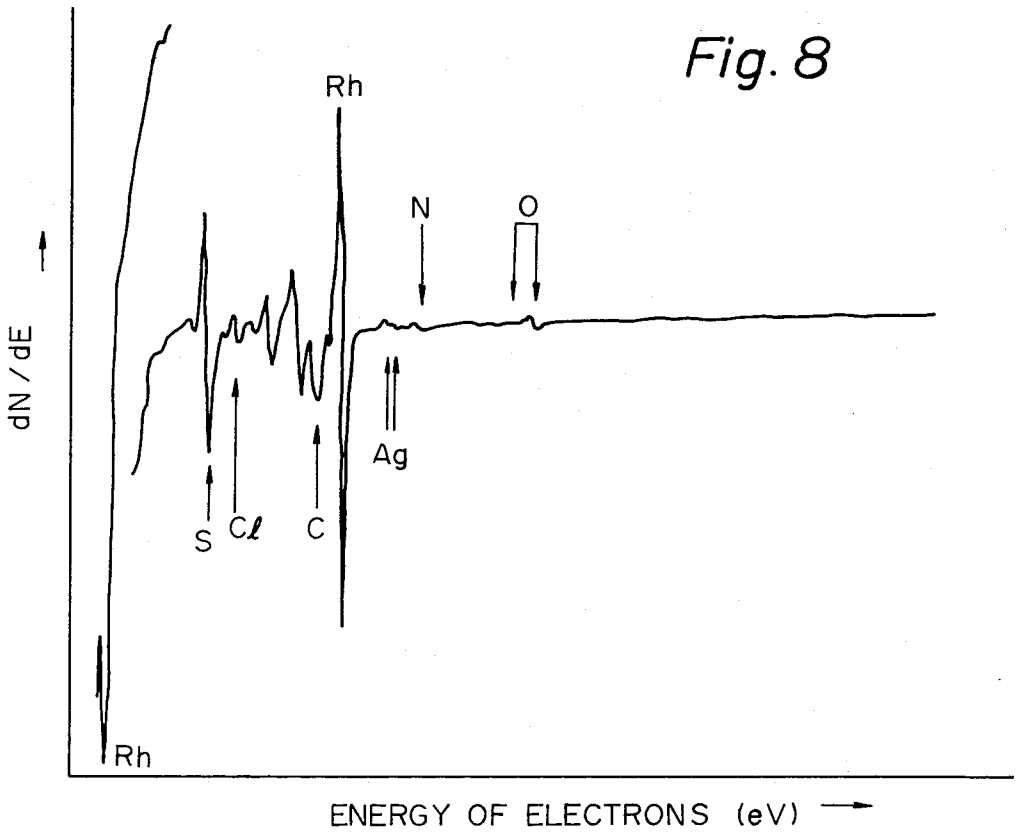
Figure 9A:
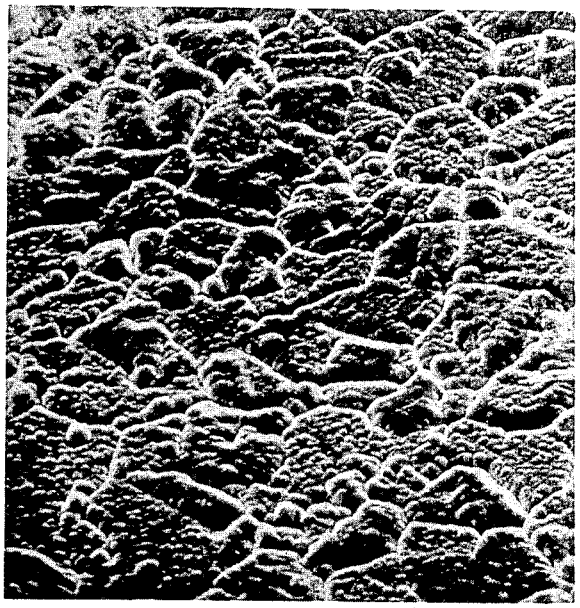
Figure 11:
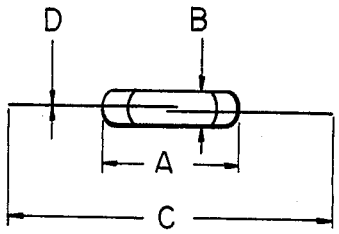
Figure 14:
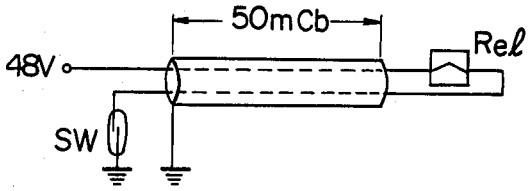
Figure 17:
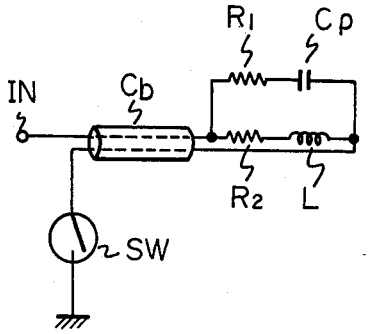
Figure 12:
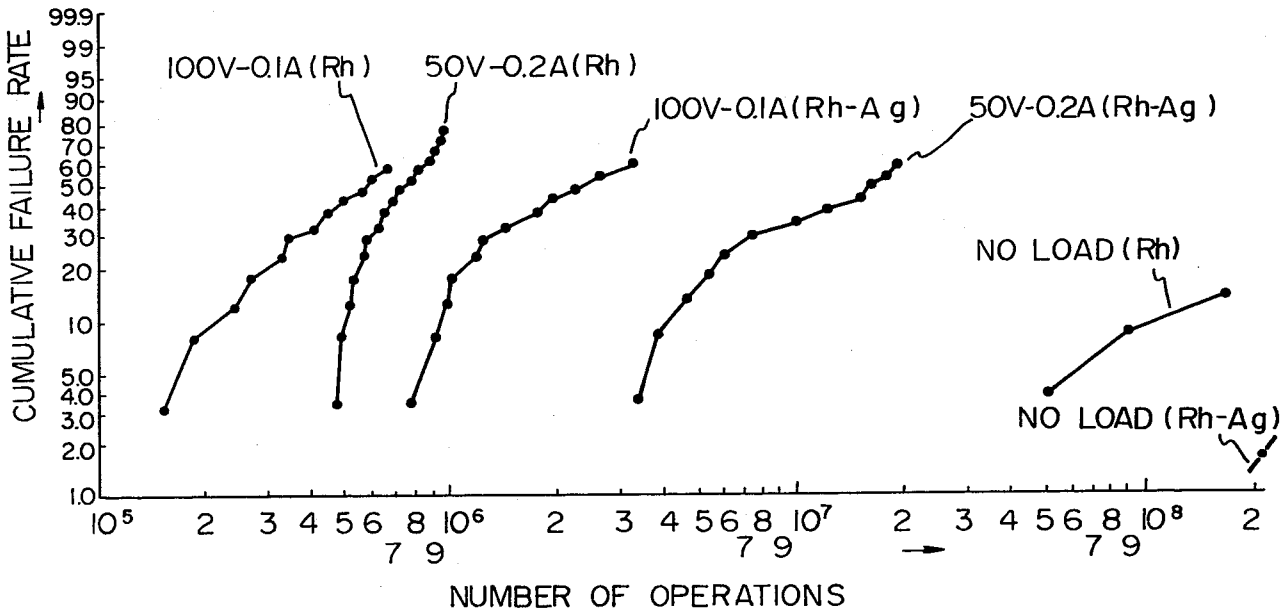
Figure 13:
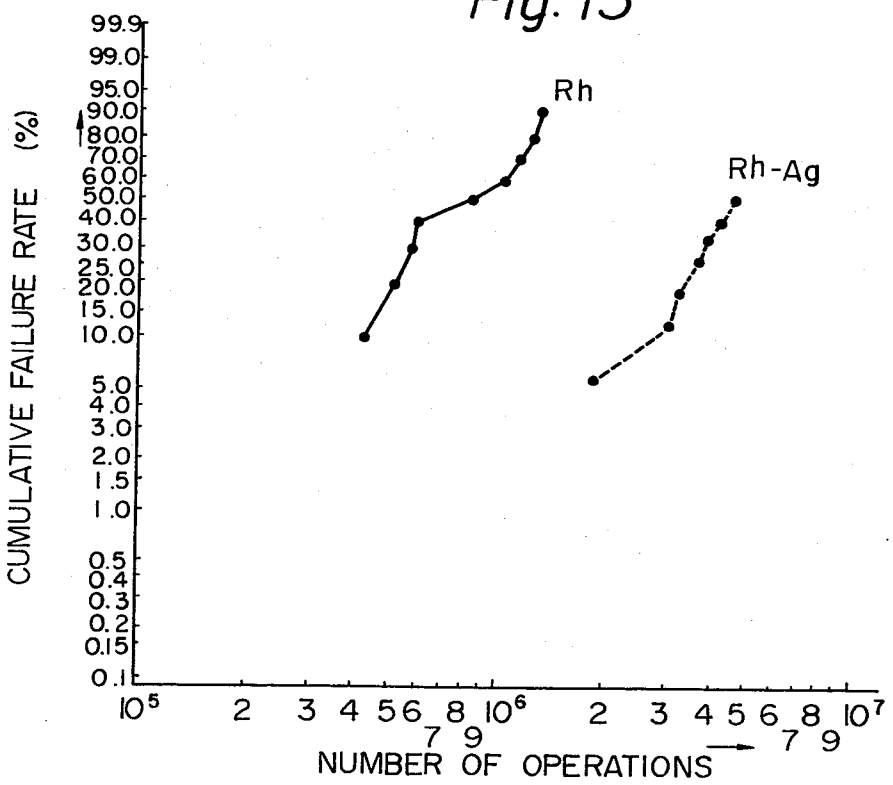
Figure 15:
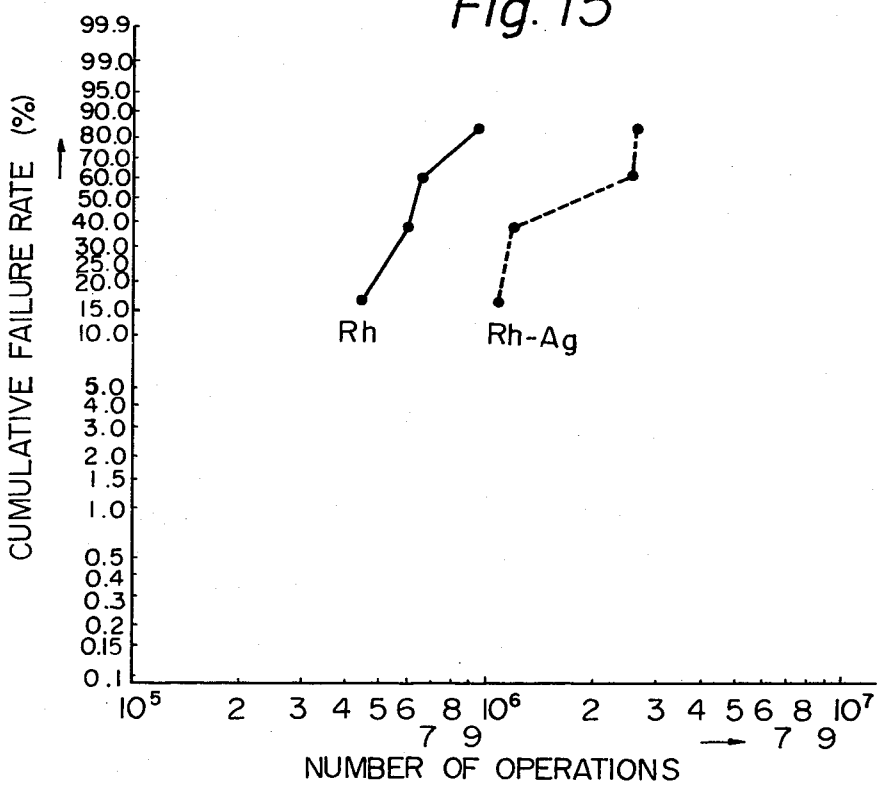
Figure 16:
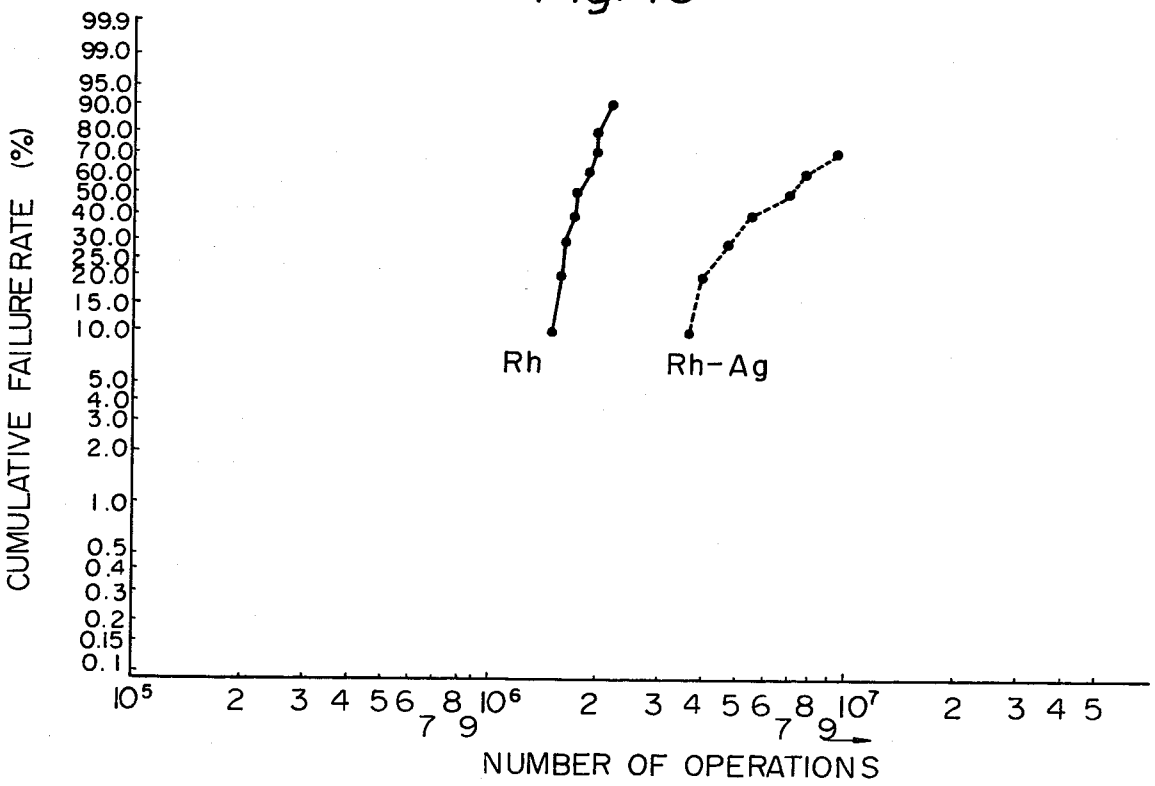
Figure 18:
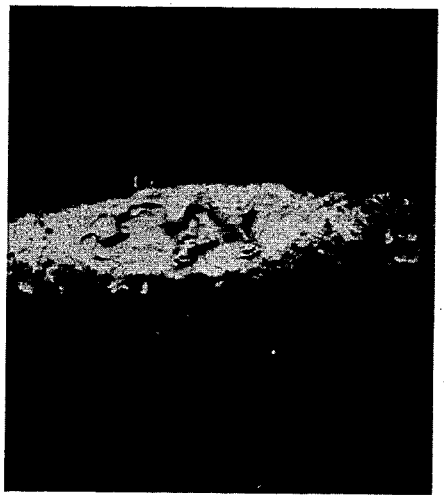
Figure 19:
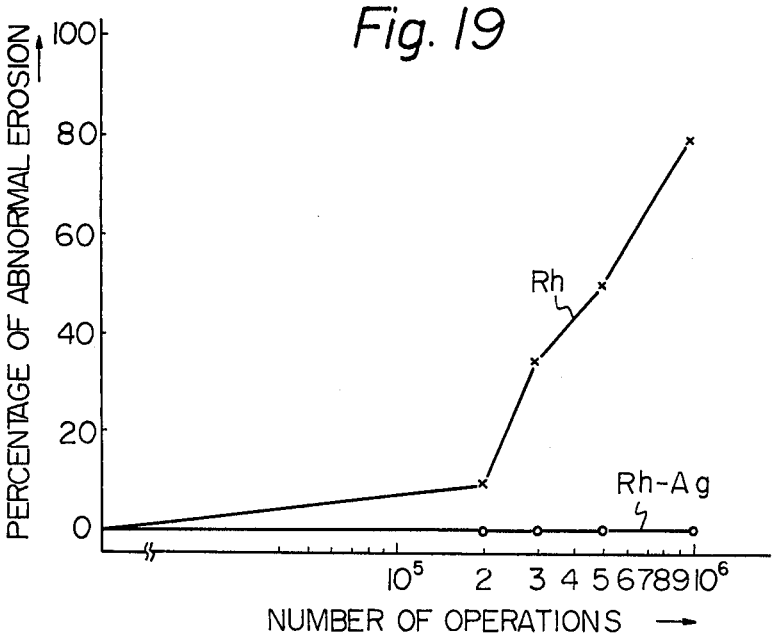
Figure 20:
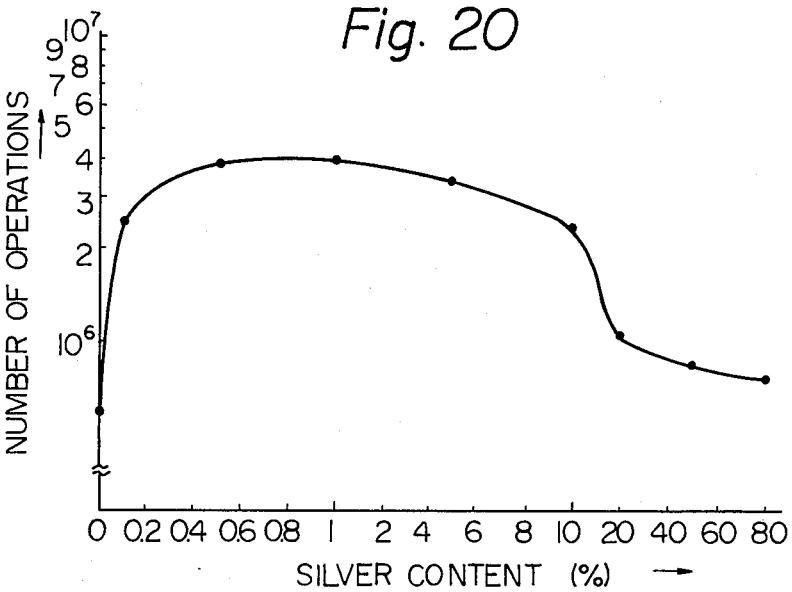

FIG. 4 indicates the influence of the amount of silver sulfate added in a plating solution and the influence of the temperature of the plating solution with regard to the silver content of an electrical contact layer which is formed by plating at a current density of 1 A/dm$^2$;

FIG. 5 indicates the influence of the silver sulfate amount and the current density of a plating solution with regard to the silver content of an electrical contact layer which is formed by a plating at a bath temperature of 40° C.;

FIG. 6 indicates the influence of the current density on the quality of a plated, electrical contact layer;

FIGS. 7 and 8 indicate the results of an Auger analysis of a conventional rhodium electrical contact and an electrical contact according to the present invention, respectively;

FIGS. 9A, B and 10A, B are scanning type electron microscopic (SEM) photographs of the known rhodium electrical contact layer and the electrical contact layer according to the present invention, respectively;

FIG. 11 is a schematic illustration of a reed switch;

FIG. 12 is a logarithmic graph illustrating a cumulative failure rate of reed switches;

FIG. 13 is a logarithmic graph illustrating the cumulative failure rate of reed switches tested in a circuit as illustrated in FIG. 14;

FIG. 14 illustrates a life testing circuit having a cable- and relay-load;

FIG. 15 is a graph similar to FIG. 13;

FIG. 16 is a logarithmic graph illustrating a cumulative failure rate of reed switches tested in a circuit as illustrated in FIG. 17;

FIG. 17 illustrates a life testing circuit having a cable- and inductance-load;

FIG. 18 is a microscopic photograph of an abnormally eroded contact layer;

FIG. 19 is a graph illustrating the percentage ratio of electrical contacts which displayed the abnormal erosion, and;

FIG. 20 is a graph illustrating the influence of silver content on the number of operation of reed switches.

Figure 2:
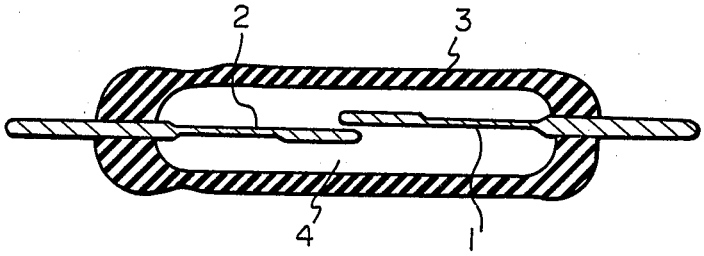
FIG. 2 is a cross sectional view of a sealing switch.

In FIG. 2, an embodiment of an electrical contact of a switch according to the present invention is illustrated. In this embodiment, the rhodium electrical contact according to the present invention is formed on a pair of movable bodies, and these movable bodies are closable due to the application of a magnetic field to these bodies. However, the electrical contact according to the present invention can be used not only in the switch illustrated in FIG. 2, but also, in known switches wherein at least one movable body provided with the rhodium electrical contact thereon is used for realizing the switching function.

Referring to FIG. 2, a pair of the movable bodies, hereinafter referred to as reed pieces 1 and 2, are gastightly sealed in an ampoule, such as a glass tube 3. The reed pieces 1 and 2 are supported by and inserted into the glass tube 3 from opposite directions. The front ends of the respective reed pieces are opposite to and overlap with each other with an appropriate gap therebetween.

The reed pieces 1 and 2 consist of a ferromagnetic metallic material, such as an iron-nickel alloy, iron-nickel-cobalt alloy and iron-cobalt-niobium alloy. The glass tube 3 protects the reed pieces from dust and harmful gases in the air and supports the reed pieces 1 and 2 at the terminal sealing position of the glass tube 3.

Figure 3:
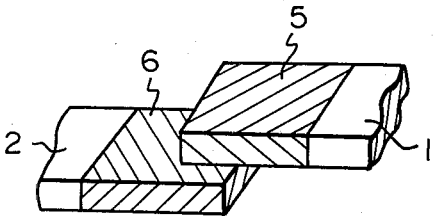
FIG. 3 is a partial view of a contact part of the switch illustrated in FIG. 3.

On the front ends 5 of the reed pieces illustrated in FIG. 3, the rhodium contact layer including silver is deposited by an electrolytic plating, welding or stamping. The overlaping portion of these front ends constitute the contact part of the reed switch. The thickness of the rhodium electrical contact layer is preferably from 2 to 4 microns, and the silver content is preferably from 0.5 to 3 atomic %.

Plating solutions for forming the rhodium-silver electrical contact according to the present invention may be those containing a silver compound, which is added to: (a) a rhodium plating solution disclosed in Japanese Published Patent Application No. 36-19659 and containing from 2 to 10 g/l of rhodium in the rhodium sulfate, from 5 to 10 ml of sulfuric acid, from 10 to 100 g/l of magnesium sulfamate and from 0 to 50 g/l of magnesium sulfate; (b) a rhodium plating solution disclosed in Japanese Published Patent Application No. 35-2761 and containing from 20 to 100 ml/l of a radical sulfuric acid, from 2 to 5 g/l of rhodium in rhodium sulfate and from 2 to 5 g/l of magnesium sulfate. The silver compound is preferably silver sulfate or silver nitrate. In order to control the silver content in the electrical contact, the additive amount of silver compound in and the temperature of a plating bath can be controlled as in the following examples.

In an experiment conducted by the present inventors, electrical contact layers were produced by using a plating bath not more than 10 g/l of silver sulfate. The silver content of the electrical contact layers was obtained by an EPMA (electron probe micro-analysis). The silver content in atomic % is calculated by the following formula.

$$\text{Ag (\%)} = \frac{\text{(Count of silver from a Rh—Ag plating layer)} - \text{(Noise)}}{\text{(Count of silver from a 100\% Ag plating layer)} - \text{(Noise)}} \times 100$$

As will be understood from FIGS. 4 and 5, the required silver content can be obtained by adjusting the silver sulfate concentration in the range of from 1 to 10 g/l and the bath temperature in the range of from 30° to 40° C.

In FIG. 6, indicating the result of an experiment conducted by the present inventors, the influence of current density on a plating layer is illustrated. The plating layer was produced by a plating solution containing 7 g/l of silver sulfate. The temperature of the plating solution was 40° C. The defect ratio denoted in FIG. 6 is expressed by formula:

$$\frac{\text{Number of defective reed pieces}}{\text{Number of plated reed pieces}} \times 100\%$$

When the current density is from 1.0 to 1.5 A/dm$^2$, the electrical contact layer without defects, namely cracks and blistecs, can be obtained, as can be understood from FIG. 6.

In FIG. 7 the results of an Auger analysis of the surface of a conventional rhodium contact material layer are indicated. Referring to FIG. 7, the abscissa indicates an energy of emission electrons, and the ordinate indicates a differential value (dN/dE) of the number of the electrons (N) with respect to the energy (E). In FIG. 7, the electron energies emitted from the atoms of rhodium, bismuth, sulfur, chlorine, carbon, nitrogen and oxygen are indicated. The rhodium plating material layer, therefore, contained, in addition to rhodium, bismuth, sulfur, chlorine, carbon, nitrogen and oxygen. The sulfur, chlorine and oxygen are believed to be incorporated into the rhodium plating layer from the plating solution, while the nitrogen is believed to be incorporated into the rhodium plating layer from gas enclosed in the ampoule of a reed switch.

FIG. 8 indicates similar results to those in FIG. 7. The plating material layer was formed by an alloy-electrolytic plating of rhodium and silver on the contact part of reed pieces which were dipped into the alloy plating solution. The current density was 1.5 A/dm$^2$, the plating bath temperature was 55° C. and the plating efficiency was 72%. The thickness of the plating material layer was 2 microns.

As will be understood from FIG. 8, the plating layer produced by the alloy plating mentioned above contains silver. Neither FIG. 7 nor FIG. 8 can be employed for quantitative analysis of the elements. It is, however, believed from the dN/dE values in FIG. 8 that the silver content is lower than, for example, the sulfur content. The electrical contact according to the present invention must contain the rhodium as a major portion, and from 0.1 to 10% of silver, and can contain unavoidable impurities in an amount higher or lower than the silver content. The impurities may be incorporated into the electrical contact during the production or use thereof.

The rhodium-silver plating layer can be formed not only by the alloy-electrolytic plating explained above, but also, by firstly, electrolytically depositing a silver layer on reed pieces and, then, electrolytically depositing rhodium on the silver layer, and finally, heating these layers to a diffusion temperature of silver and rhodium.

Figure 9B:
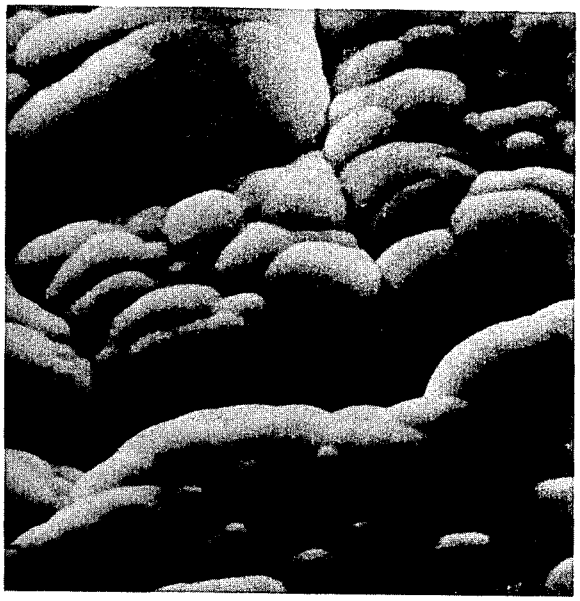
Figure 10A:
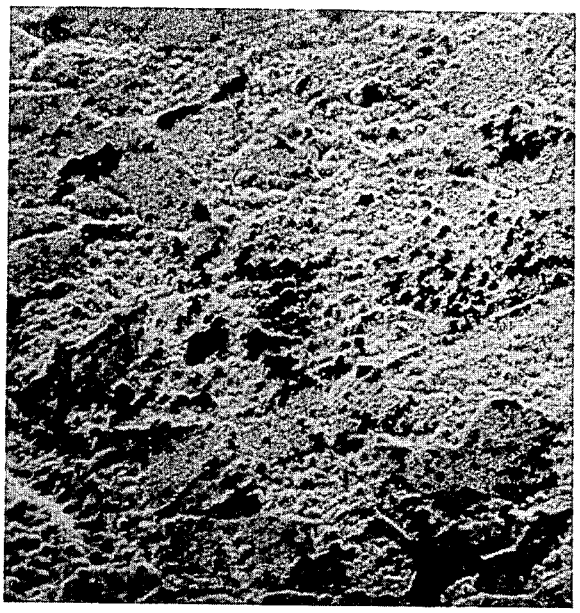
Figure 10B:
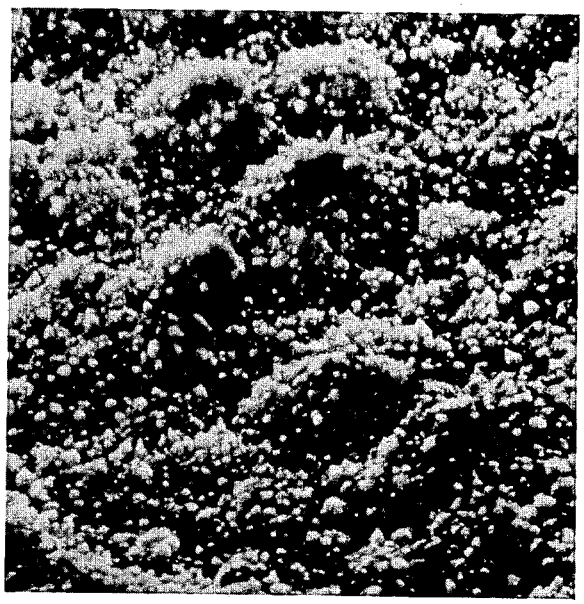

From a comparison of FIGS. 10A and 10B, showing an SEM structure of a conventional rhodium plating layer, with FIGS. 9A and 9B, showing the rhodium plating layer containing 1% of silver, it will be understood that the metallic crystals are deposited densely, namely, are close to each other via a thin crystal boundaries, in FIGS. 9A and 9B. As a result of the dense crystal structure, the bonding of the contact material layer to the reed pieces is stronger in the present invention than in the conventional rhodium contact. It is believed that the long life of the electrical contact according to the present invention is achieved by the strong bonding.

Tests of reed switches conducted by the present inventors are hereinafter described. However, several terms used in this description are first explained.

The cumulative failure rate is expressed by:

$$\frac{\text{Cumulative failure number}}{\text{Number of tested reed switches } (n_0)} \times 100(\%).$$

The cumulative failure number is expressed by:

$$n_1 + n_2 + \ldots + n_i$$

wherein $n_i$ is the failure number at a predetermined number of operation times $N_i$ of a reed switch.

Life of Electrical Contact

The life of an electrical contact ends when the electrical contact exhibits a making inferiority or a breaking inferiority. Such end of the life of an electrical contact life is referred to as a failure.

Making Inferiority

When the contact resistance is more than 1Ω, or when an output voltage of an electrical contact of a switch is decreased to less than 90% of the voltage applied to an input of the switch, the properties of the electrical contact are deteriorated, which is referred to as a making inferiority.

Breaking Inferiority

When an electrical contact cannot be broken due to the sticking of the electrical contact material layers, the properties of the electrical contact are deteriorated, which is referred to as a breaking inferiority.

The shape of the reed switches produced by the present inventors is illustrated in FIG. 11. The length A of the ampoule of the reed switches was 13.7 mm and the outer diameter B thereof was 2.3 mm. The diameter D of the reed wires was 0.53 mm. A solder material was applied on the reed wires. The length C between the ends of the reed wires was 56.5 mm.

The contact force of the reed pieces of the reed switches was 3.3 g (0.0033 kgf) and the retractile force of the reed pieces was 2.2 g (0.0022 kgf).

A contact material layer was formed on the reed pieces made of a 52 alloy (52% Ni-Fe alloy) by, first, electrolytically depositing a 0.5 micron thick Au layer and, then, a 1.2 micron thick, Rh layer or Rh-Ag layer. The plating condition in Examples 1 through 5 was as follows: current density of 1.5 $A/dm^2$; bath temperature of 40° C., and concentration of silver sulfate of 2.8 g/l. The Rh-Ag layer contained 1% of silver.

EXAMPLE 1

Every twenty reed switches were tested under three loading conditions. All of the electrical contacts of the reed switches failed due to making failure. The cumulative failure rates of the electrical contacts are indicated in FIG. 12.

Figure 1:
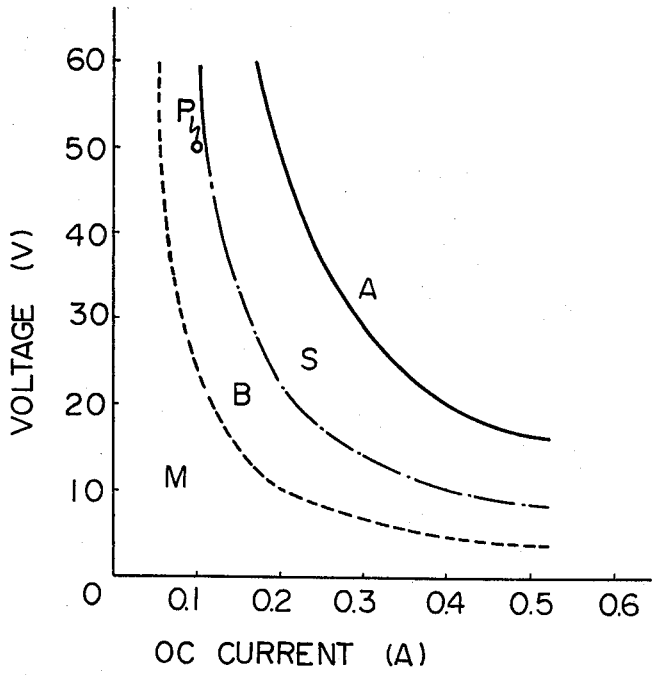

In FIG. 12, the loading condition of 100 V and 0.1 A corresponds to the region S (short arc) in FIG. 1, and the loading condition of 50 V and 0.2 A approximately corresponds to the boundary between the region S (short arc) and the region A (arc). The load was resistance. It will be apparent from FIG. 12 that the electrical contacts (Rh-Ag) according to the present invention exhibits, under every loading or operating condition indicated, a longer life than that of the conventional rhodium electrical contact (Rh). When the electrical contact (Rh) according to the present invention was operated without application of the load, no failure was demonstrated until the number of operations reached $2\times10^8$. This fact proves that abnormal erosion is unlikely to occur in the electrical contact of the present invention.

EXAMPLE 2

A test of the reed switches was carried out under loading conditions different from those in FIG. 12. The results of the test in this Example will be illustrated with reference to FIGS. 13 and 14.

Indicated in FIG. 13 are the cumulative failure rates of the reed switches which were tested in the test circuit illustrated in FIG. 14. In FIG. 14, one reed switch Sw was connected via a make-relay contact Rel to a current source and the connecting wires of the reed switch Sw was inserted into a 50 m long cable Cb. The current through the reed switch Sw was 100 mA and the voltage of the current source was 48 V, which corresponds to the point P in FIG. 1, namely the loading condition in telephone exchanges.

In a telephone exchange a number of pairs of cables run parallel, so that a floating capacitance is formed between each pair. A reed switch connects two cables together. Electric charges are stored between the cables due to the floating capacitance therebetween. The electric charges are instantaneously discharged at the electrical contacts of the reed switches, when the electrical contacts are closed, namely made, and therefore, a discharge current of a few hundred milliamperes is conducted during a period of 1 micron sec or less through the electrical contacts. The surface of electrical contacts are eroded due to the electric discharge. If the load of the reed switches is not a capacitance but a mere resistance, the discharge current does not flow through the electrical contacts at the closing operation thereof. Accordingly, in order to realize as severe a condition as in a telephone exchange, the wires were coaxially inserted into the cable (Cb) as illustrated in FIG. 14. The sheath of the cable was grounded and a dielectric material filled between the cable sheath and the wire acted as a capacitor. The test of the reed switches in this Example was carried out in the electric circuit of FIG. 14, simulating the circuit of the telephone exchange.

Fifteen reed switches having the Rh-Ag contact according to the present invention and ten reed switches having the conventional Rh contact were tested. The average value of the cumulative failure rate is indicated in FIG. 13. It will be clear from FIG. 13 that the electrical contact according to the present invention exhibits a longer life than the conventional one under the loading condition present in telephone exchanges.

EXAMPLE 3

Illustrated in FIG. 15 are the cumulative failure rates of reed switches which were tested under the same condition as explained with reference to FIG. 14. However, the current was 200 mA and the average cumulative failure rate was obtained from four reed switches. As will be understood from FIG. 15, the life of the electrical contact according to the present invention (Rh-Ag) is longer than that of the conventional electrical contact (Rh).

EXAMPLE 4

Indicated in FIG. 16 are the cumulative failure rates of reed switches which were tested in the test circuit illustrated in FIG. 17. In FIG. 17, "In" indicates an input terminal, to which a voltage of 52 V was applied and "Cb" indicates a 50 m long cable. $R_1$, $R_2$, CP and L indicate a 500Ω resistor, a 800Ω resistor, a 0.22 μF capacitor and 1H inductance, respectively.

The plotted points in FIGS. 13, 15 and 16 indicate the cumulative failure rates of contacts failed due to breaking failure. In the tests explained with reference to these figures making failures did not occur.

EXAMPLE 5

The occurrence of abnormal erosion on the electrical contacts, which were tested in the experiments explained with reference to FIG. 12, was investigated and the results of the investigation are indicated in FIG. 19. The reed switches having electrical contacts were operated without the application of a load. The surface of an abnormally eroded electrical contact is shown in FIG. 18. The ratio of the abnormal erosion occurrence, namely the percentage ratio of the abnormally eroded electrical contacts based on the total electrical contacts, is indicated along the ordinate of FIG. 19. The curves Rh-Ag and Rh indicate the electrical contact according to the present invention and the known electrical contact, respectively. When number of operations, indicated along the abscissa of FIG. 19, exceeds approximately 200,000, the ratio of abnormal erosion occurrence of the Rh curve becomes suddenly high. On the other hand in the Rh-Ag curve, the ratio mentioned above is zero even at a number of operations of 1,000,000.

EXAMPLE 6

Electrical contacts containing various amounts of silver were subjected to the life test under such a resistance load that a current of 0.1 A was conducted through reed switches having the electrical contacts at an application of 50 V to the load and switches. The silver content of the rhodium-silver plating layer of the electrical contacts was in the range from 0 to 80%. The results of the life test are indicated in FIG. 20. The ordinate of FIG. 20 indicates the number of operations, at which 5% of the tested reed switches failed. As will be understood from FIG. 20, the life of the electrical contact with a Ag content of 0.1% is considerably improved over that of a pure rhodium electrical contact, and the life is appreciably reduced by an Ag addition of more than 10%.

We claim:

1. An electrical contact of a switch, wherein said contact consists essentially of rhodium and 0.1 to 10 atomic % of silver;

said electrical contact being formed on at least one movable body, said movable body being moved in said switch due to a magnetic field applied to said movable body;

said movable body also being sealed gas-tight in an ampoule;

said at least one movable body comprising a pair of reed pieces of a reed switch, said reed pieces being attracted to each other due to the applied magnetic field;

said reed pieces being inserted through said ampoule at opposite ends of said ampoule, wherein the front opposing ends of the respective reed pieces overlap each other to form a gap therebetween within said ampoule;

said electrical contact being formed by an electrolytic plating process.

2. An electrical contact according to claim 1, wherein the silver content of said electrical contact is from 0.5 to 3 atomic %.

3. An electrical contact according to claim 1 or 2, wherein said switch has a non-working condition.

4. An electrical contact according to claim 1 or 2, wherein said electrical contact is formed on said at least one movable body having a gold layer thereon.

5. An electrical contact according to claim 1 or 2, wherein said switch has a current and voltage working condition wherein arc discharge erosion can occur.

6. An electrical contact according to claim 1 or 2, wherein said switch has a current and voltage working condition wherein short arc discharge erosion can occur.

7. An electrical contact according to claim 1 or 2, wherein said switch has a current and voltage working condition wherein bridge erosion can occur.

8. An electrical contact according to claim 1 or 2, wherein said switch has a low-level current and voltage working condition wherein mechanical erosion can occur.

9. An electrical contact according to claim 1 or 2, wherein said switch has a non-working condition wherein mechanical erosion can occur.

10. An electrical contact according to claim 1 or 2, wherein said electrical contact has a low resistivity, a high hardness, and a high resistance against corrosive gases.

11. An electrical contact according to claim 1 or 2, wherein said at least one movable body is formed of a ferromagnetic metallic material.

12. An electrical contact according to claim 1 or 2, wherein said electrical contact is approximately 1.75 to 4 microns in thickness.

13. An electrical contact according to claim 1 or 2, wherein said electrical contact is formed by an alloy-electrolytic plating process using a rhodium plating solution with a silver sulfate concentration.

14. An electrical contact according to claim 13, wherein the silver sulfate concentration is approximately in the range of from 1 to 10 g/l.

15. An electrical contact according to claim 14, wherein a bath temperature was used approximately in the range of from 30° to 55° C.

16. An electrical contact according to claim 13, wherein a current density for said alloy plating using the rhodium solution with silver sulfate is approximately from 1.0 to 1.5 $A/dm^2$.

17. An electrical contact according to claim 1 or 2, wherein said electrical contact is formed on said at least one movable body by (a) electrolytically depositing a silver layer on said movable body; (b) electrolytically depositing a rhodium layer on said silver layer; and (c) heating said layers to a diffusion temperature of rhodium and silver.

18. An electrical contact according to claim 1 or 2, wherein the Micro Vickers hardness is the same as that for a contact composed solely of rhodium, approximately 400.

19. An electrical contact according to claim 1 or 2, wherein said movable body comprises a ferromagnetic material, said contact being formed on said movable body.

* * * * *

UNITED STATES PATENT AND TRADEMARK OFFICE

CERTIFICATE OF CORRECTION

PATENT NO. : 4,348,566

DATED : Sep. 7, 1982

INVENTOR(S) : Baba et al.

It is certified that error appears in the above-identified patent and that said Letters Patent is hereby corrected as shown below:

Front page, [57] Abstract,
line 2, "Ag" should be --silver (Ag)--;
line 3, after "contact" (first occurrence) insert --material--;
line 4, delete "a" (second occurrence);
line 5, after "tions" insert --of the switch, i.e.,--
line 7, after "condition" change "," to --where an electrical current is conducted through or broken by the switch and--;
line 8, change "is caused" to --can occur--.

Column 1, line 4, insert heading --Background of the Invention--;
Column 1, line 9, ". The" should be --: low--;
Column 1, line 10, "is low, the" should be --, high--;
Column 1, line 11, "are high, the" should be --, low--;
Column 1, line 12, "is low, the" should be --, good--;
Column 1, line 13, "is good and the" should be --and sufficiently high--; delete "is suffi-";
Column 1, line 14, delete "ciently high";
Column 1, line 28, after "following" delete "a";
Column 1, line 35, after "pieces" insert --having a resilient property--;
Column 1, line 41, delete "having a";
Column 1, line 42, delete "resilient property";
Column 1, line 60, after "can" insert --thus--;
Column 1, line 61, "such" should be --this--.
Column 2, line 27, before "are" insert --,--;
Column 2, line 30, after "C" delete ",";
Column 2, line 36, "on" should be --of--;
Column 2, line 39, after "C" delete ",";
Column 2, line 49, after "of" insert --the--;
Column 2, line 52, after "above" insert --in items B and A--; "made" should be --formed--;
Column 2, line 54, ", when" should be --as--;

UNITED STATES PATENT AND TRADEMARK OFFICE

CERTIFICATE OF CORRECTION

PATENT NO. : 4,348,566

DATED : Sep. 7, 1982

INVENTOR(S) : Baba et al.

It is certified that error appears in the above-identified patent and that said Letters Patent is hereby corrected as shown below:

Column 2, line 55, "due to" should be --when--; after "field" insert --is--.
Column 3, before line 31, insert heading --Summary of the Invention--;
Column 3, line 31, after "is" insert --an--;
Column 3, line 34, "of" should be --for the--;
Column 3, line 52, "condition" should be --contacts--;
Column 3, before line 61, insert heading --Brief Description of the Drawings--;
Column 3, line 62, after "20" insert --as well as Fig. 1 noted above,--; after "wherein:" insert new paragraph --FIG. 1 illustrates electric current and voltage regions and conditions of rhodium electrical contacts of a reed switch;--
Column 3, line 63, "sealing" should be --sealed reed--;
Column 3, line 65, "3" should be --2--.
Column 4, line 15, after "of" insert --the electrical contact layer according to the present invention and--;
Column 4, line 16, delete "and the electrical contact layer";
Column 4, line 17, delete "according to the present invention";
Column 4, line 20, after "switches" insert --using conventional rhodium electrical contacts and those using an electrical contact according to the present invention under three loading conditions--;
Column 4, line 23, after "14" insert --with a 100 mA current--;
Column 4, line 26, "is a graph" should be --,--; after "13" insert --, is a logarithmic graph illustrating the cumulative failure rate of reed switches tested in a circuit as illustrated in FIG. 14 but with a 200 mA current--;
Column 4, line 34, after "of" insert --the conventional rhodium--;
Column 4, line 35, after "contacts" insert --and contacts according to the present invention--;

UNITED STATES PATENT AND TRADEMARK OFFICE

CERTIFICATE OF CORRECTION

PATENT NO. : 4,348,566

DATED : Sep. 7, 1982

INVENTOR(S) : Baba et al.

It is certified that error appears in the above-identified patent and that said Letters Patent is hereby corrected as shown below:

Column 4, before line 39, insert heading --DESCRIPTION OF THE PREFERRED EMBODIMENT--;
Column 4, line 57, after "gap" insert --formed--;
Column 4, line 60, "and" should be --or--;
Column 4, line 64, after "pieces" insert --as--;
Column 4, line 67, after "ing" insert --process--; after "ends" insert --of the reed pieces--.
Column 5, line 12, after "sulfate;" insert --or--;
Column 5, line 46, after "by" insert --the--;
Column 5, line 53, "blistecs" should be --blisters--;
Column 5, line 58, after "electrons" insert --(eV)--;
Column 5, line 61, "emitted" should be --were emitted as indicated--;
Column 5, line 63, delete "are indicated".
Column 6, line 3, "to those" should be --of an Auger analysis to those shown--;
Column 6, line 4, after "formed" insert --, however,--;
Column 6, line 15, after "values" insert --shown--;
Column 6, line 36, after "via" delete "a";
Column 6, line 37, delete ", in FIGS. 9A and 9B";
Column 6, line 62, after "Such" insert --an--.
Column 7, line 1, "are deteriorated, which" should be --have deteriorated and this--;
Column 7, line 6, "are deteriorated," should be --have deteriorated and thus--;
Column 7, line 7, delete "which";
Column 7, line 40, "exhibits" should be --exhibited--;
Column 7, line 43, "(Rh)" should be --(Rh-Ag)--;
Column 7, line 60, "was" should be --were--;
Column 7, line 63, after "in" insert --the graph of--.
Column 8, line 7, after "surface of" should be --surfaces of the--;
Column 8, line 31, after "same" insert --loading--;

UNITED STATES PATENT AND TRADEMARK OFFICE

CERTIFICATE OF CORRECTION

PATENT NO. : 4,348,566

DATED : Sep. 7, 1982

INVENTOR(S) : Baba et al.

It is certified that error appears in the above-identified patent and that said Letters Patent is hereby corrected as shown below:

Column 8, line 37, "is" should be --was found to be--;
Column 8, line 43, ""In"" should be --"IN"--;
Column 8, line 44, after "terminal" delete ",";
Column 8, line 45, "CP" should be --Cp--;
Column 8, line 47, after "respectively." insert --It is clear from FIG. 16 that the electrical contact according to the present invention (Rh-Ag) again exhibited a longer life than the conventional contact (Rh).--;
Column 8, line 48 "in" should be --illustrated in the--; after "16" insert --for the above Examples--;
Column 8, line 67, after "When" insert --the--.
Column 9, line 11, after "through" insert --the--.

Signed and Sealed this

Third Day of May 1983

[SEAL]

*Attest:*

GERALD J. MOSSINGHOFF

*Attesting Officer*

*Commissioner of Patents and Trademarks*